US010245867B2

(12) United States Patent
Warner

(10) Patent No.: US 10,245,867 B2
(45) Date of Patent: Apr. 2, 2019

(54) THERMAL IMAGING

(71) Applicant: John C. Warner, Wilmington, DE (US)

(72) Inventor: John C. Warner, Wilmington, DE (US)

( * ) Notice: Subject to any disclaimer, the term of this patent is extended or adjusted under 35 U.S.C. 154(b) by 0 days.

(21) Appl. No.: 13/921,130

(22) Filed: Jun. 18, 2013

(65) Prior Publication Data

US 2014/0371064 A1 Dec. 18, 2014

(51) Int. Cl.

| | |
|---|---|
| ***B41M 5/323*** | (2006.01) |
| ***B41M 5/333*** | (2006.01) |
| *B41M 5/337* | (2006.01) |

(52) U.S. Cl.

CPC ..... *B41M 5/323* (2013.01); *B41M 5/333* (2013.01); *B41M 5/3372* (2013.01)

(58) Field of Classification Search

CPC ..... B41M 5/323; B41M 5/3372
USPC ..... 503/218
See application file for complete search history.

(56) References Cited

U.S. PATENT DOCUMENTS 4,808,565 A * 2/1989 Whitcomb et al. ..... 503/211
4,985,392 A * 1/1991 Bjork ..... 503/211

* cited by examiner

*Primary Examiner* — Bruce H Hess

(57) ABSTRACT

Disclosed and claimed herein is a thermosensitive recording medium, having a base sheet; a binder; and a thermosensitive material on at least one surface of the base sheet comprising: one or more oxidizing agents; and a dye precursor.

17 Claims, No Drawings

THERMAL IMAGING

FIELD OF THE INVENTION

The present application for patent is in the field of graphic imaging technologies, specifically is in the field of thermal imaging.

BACKGROUND

Thermal printing systems use a thermal print element energized to heat specific and precise areas of a heat sensitive paper to provide an image of readable characters or graphics on the heat sensitive paper. The heat sensitive paper, also known as thermal paper, includes material(s) which are reactive to applied heat. The thermal paper is a self-contained system, referred to as direct thermal, because ink need not be applied.

Thermal printing systems are ubiquitous and typically include point of sale (POS) devices, facsimile machines, adding machines, automated teller machines (ATMs), credit card machines, gas pump machines, electronic blackboards, and the like.

Typical chemistries used in thermal papers are based on (a) silver salts combined with reducing agents that are activated by heat, and (b) dye-developing type systems that comprise a colorless dye (color former), a bisphenol such as bisphenol-a (color developer) and a sensitizer. These solid materials are reduced to very small particles by grinding and incorporated into a coating formulation along with any optional additives such as pigments, binders and lubricants. The coating formulation is then applied to the surface of a support system, typically a base sheet and base coating. The color is formed by application of heat to the thermosensitive coating to melt together and thereby cause a darkening reaction.

While the above described imaging systems produce acceptable thermographic results, they suffer from certain drawbacks. For example, silver is costly and its price is uncertain in the world marketplace. Moreover, bisphenol compounds such as bisphenol-A have been listed among the chemicals that may cause disruption of reproductive function in animals and humans. The route of entry in humans is typically through the skin and can be facilitated by oils and hand creams that may be present on the skin. Biedermann et al., Anal Bioanal Chem., 398, 571, (2010) report that a cash register worker may absorb as much as 71 micrograms of bisphenol-A in a 10-hour work day. Further, owing to the extensive use of bisphenol-A based thermographic materials, environmental impact is a concern because thermal papers are recycled along with ordinary paper. The recycled materials containing adventitious bisphenol-A may later be used as ordinary office paper or in applications such as food packaging.

Problem to be Solved

There remains a continuing need to provide a low cost imaging chemistry for direct thermographic materials that generates a dense neutral and storage stable image upon thermal imaging, but does not have the attendant environmental and health drawbacks associated with bisphenols such as bisphenol-A.

DETAILED DESCRIPTION

As used herein, the conjunction "and" is intended to be inclusive and the conjunction "or" is not intended to be exclusive unless otherwise indicated. For example, the phrase "or, alternatively" is intended to be exclusive. Further, when used in connection with chemical substitution at a specific position, the conjunction "or" is intended to be exclusive.

As used herein, the adjective "exemplary" is used simply to point to an example and is not meant to indicate preference.

Disclosed and claimed herein is a thermosensitive recording medium, having a base sheet; a binder; and a thermosensitive material on at least one surface of the base sheet comprising: one or more oxidizing agents; and a dye precursor having the formula;

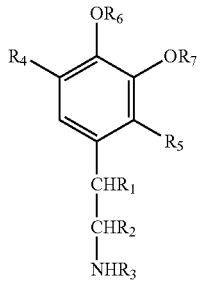

wherein $R_1$ and $R_2$ can be the same or different and are: H, alkyl or 1-4 C, $NH_2$, OH, COOR' wherein R' is alkyl of 1-4C or H, $CONH_2$, halogen, OR" wherein R" is alkyl of 1-4C, $CH_2$ OH, $CH_2NH_2$, CONR'R" wherein R' and R" can be the same or different; $R_3$ is H or alkyl of 1-4C or COR"; $R_4$, $R_5$ can be the same or different and are: H, alkyl of 1-4C, $NH_2$, OH, COOH, $CONH_2$, halogen, OR", $NO_2$, $SO_3$, HNR", or NR"R" or any pharmaceutically acceptable salts thereof or mixtures thereof and wherein $R_6$ and $R_7$ can be the same or different and can be hydrogen, a carboxylate group, a borate group or a silicate group. Exemplary materials used as dye precursors include L-Dopa, R-Dopa, salts thereof, including pharmaceutically suitable salts thereof, and esters thereof, including pharmaceutically suitable esters thereof.

As will become evident, various modifications and enhancements of the above embodiment are within the scope of the disclosed and claimed subject matter.

Without limitation, a base sheet may comprise paper, coated paper, a film, a plastic material such as Mylar, a composite material such as aluminized Mylar®, layered polymer materials, filled polymer materials or the like, a solid material such as a phenolic-based printed circuit board, silica glass or the like, or a metal material such as metal foil. Further, the base sheet may be treated with materials that promote adhesion, improve the durability of the final recording medium or impart a desired finish to the recording medium.

Without limitation, binders can comprise a resin or resins chosen from polystyrene, polyvinyl alcohol, polyvinyl pyrrolidone, polyacrylamide, polymethacrylamide, polyacrylic acid, polymethacrylic acid, polyethylene glycol, proteinaceous binders such as gelatin. modified gelatines such as phthaloyl gelatine, polysaccharides, such as starch, gum arabic and dextran, water-soluble cellulose, resin having an ether bond, resin having a carbamoyl group, resin having a carboxyl group, and derivatives or combinations thereof. Binders can be applied in water soluble and water dispersible formulations, wherein volatile organic solvents are kept below 5% w/w of the total formulation. In addition, when required, binders can be applied from non aqueous solvents.

Without limitation, oxidizing agents can be salts whose anion is chosen from periodate, persulfate, perborate, iodate, peroxydisulfate, monopersulfate, or hypochlorite. In addition, other oxidizing agents can be used. These include (2,2,6,6-tetramethylpiperidin-1-yl)oxyl (TEMPO), ferric chloride, peroxides such as, for example, hydrogen peroxide, tert-butyl hydroperoxide, benzoyl peroxide, other organic based peroxides and cerium (IV) ammonium nitrate. It is contemplated that any counter cation can be used as constituents of the anionic oxidizing agents listed above. Exemplary counter cations may be chosen from those that are pharmaceutically acceptable to form a pharmaceutically acceptable salt if safer materials are desired.

As used herein the term "oxidizing agents" includes "functional metal salts" which are any metal ion which accelerates the formation of dye from the dye precursor described above. Salts of any of a variety of metals may be employed for this purpose. By way of example of the metallic salts that may be used in accordance with the present composition, medium and process include the transition metals, for example, copper (e.g. Cu+2), titanium (e.g. Ti+2), zinc (e.g. Zn+2), iron (e.g. Fe+2 and Fe+3) nickel (e.g., Ni+2), cobalt (e.g. Co+2), lead (e.g. Pb+2), silver (e.g. Ag+1) and manganese (e.g. Mn+2). All of these metal ions given by way of illustration are capable of assisting the conversion of the dye precursor dyes described above. However, this list is not exhaustive of the metal salts that can be employed herein and is not intended to exclude or limit the scope of such metal ions that are useful in this hair coloring process. The anionic moieties of these salts may be exemplified by such anions as sulfate, lactate, tartrate, acetate, citrate, nitrate and chloride. Again, this listing is not exhaustive of those anions of the metal salts employable in this disclosure. By way of illustration of specific salts which may be used in the thermal imaging compositions, media and processes include, for example, $CuSO_4$, Ti(lactate)$_4$, $Fe(NO_2)_3$, $Fe(NO_3)_3$, $FeSO_4$, $FeCl_3$, $K_3Fe(CN)_6$, Pb(acetate)$_2$, Cu(II) (citrate), $ZnSO_4$, $NiSO_4$, Co(acetate)$_2$, $AgNO_3$, $Mn(NO_3)_2$, $MnCl_2$, and the like.

It should be mentioned that the compositions may contain one or more oxidizing agents and may be chosen from more than one chemical family.

By the term "pharmaceutically acceptable salt" is intended salts with pharmaceutically acceptable acids or bases. Pharmaceutically acceptable salts are well known in the art. For example, S. M. Berge, et al. describes pharmaceutically acceptable salts in detail in J. Pharmaceutical Sciences, 66: 1-19 (1977). The salts can be prepared in situ during the final isolation and purification of the catechol-based precursor, or separately by reacting the free base function with a suitable organic acid. Examples of pharmaceutically acceptable salts include, but are not limited to, nontoxic acid addition salts are salts of an amino group formed with inorganic acids such as hydrochloric acid, hydrobromic acid, phosphoric acid, sulfuric acid or with organic acids such as acetic acid, maleic acid, tartaric acid, citric acid, succinic acid or malonic acid or by using other methods used in the art such as ion exchange. Other pharmaceutically acceptable salts include, but are not limited to, adipate, alginate, ascorbate, aspartate, benzenesulfonate, benzoate, bisulfate, borate, butyrate, camphorate, camphorsulfonate, citrate, cyclopentanepropionate, digluconate, dodecylsulfate, ethanesulfonate, formate, fumarate, glucoheptonate, glycerophosphate, gluconate, hemisulfate, heptanoate, hexanoate, hydroiodide, 2-hydroxy-ethanesulfonate, lactobionate, lactate, laurate, lauryl sulfate, malate, maleate, malonate, methanesulfonate, 2-naphthalenesulfonate, nicotinate, nitrate, oleate, oxalate, palmitate, pamoate, pectinate, persulfate, 3-phenylpropionate, phosphate, picrate, pivalate, propionate, stearate, succinate, sulfate, tartrate, thiocyanate, toluenesulfonate, undecanoate, valerate salts, and the like. Pharmaceutically acceptable salts of carboxylates and other oxo-acids can be formed with cationic species such as alkali or alkaline earth metal ions including sodium, lithium, potassium, calcium, magnesium, and the like. Further, pharmaceutically acceptable salts include, when appropriate, nontoxic ammonium, quaternary ammonium, and amine cations as well as natural product cations such as choline and acetyl choline and the like. Anionic counterions include halides, hydroxide, carboxylate, sulfate, phosphate, nitrate, alkyl (having from 1 to 6 carbon atoms) sulfonate and aryl sulfonate.

Without limitation, the thermosensitive recording medium may contain basic materials. Without intending to be bound by theory, basic materials may be useful in catalyzing the change in optical density of the recording medium when heat is applied. Such basic materials include ammonia and organic amines such as alkyl amines, and aryl amines, as well as salts of organic and inorganic acids. These salts may have anions that include adipate, alginate, ascorbate, aspartate, benzenesulfonate, benzoate, bicarbonate, bisulfate, borate, butyrate, camphorate, camphorsulfonate, carbonate, citrate, cyclopentanepropionate, digluconate, dodecylsulfate, ethanesulfonate, formate, fumarate, glucoheptonate, glycerophosphate, gluconate, hemisulfate, heptanoate, hexanoate, hydroiodide, 2-hydroxy-ethanesulfonate, lactobionate, lactate, laurate, lauryl sulfate, malate, maleate, malonate, methanesulfonate, 2-naphthalenesulfonate, nicotinate, nitrate, oleate, oxalate, palmitate, pamoate, pectinate, persulfate, 3-phenylpropionate, phosphate, picrate, pivalate, propionate, silicate, stearate, succinate, sulfate, tartrate, thiocyanate, toluenesulfonate, undecanoate, valerate and the like.

Notwithstanding the foregoing, several studies have suggested that ammonia and organic amines are either toxic or can have undesirable side-effects such as skin irritation, burning, redness, itchy skin, swelling, or breathing trouble. In certain applications, it may be desirable to use bases other than ammonia and organic amines, whether primary, secondary, tertiary or pyridinic.

In order to control the darkening reaction so that it does not occur prematurely, it may be desirable to sequester some of the chemical constituents of the thermosensitive imaging medium. For example, sodium bicarbonate may be sequestered by encapsulation or microencapsulation. Microencapsulated sodium bicarbonate is commercially available from Encapsulation Systems Corporation under the trade names OST-9362-01 and OST-9362-02. In addition, microencapsulated sodium bicarbonate is available from Balchem corporation under the trade names Bakesure 184 and Bakesure 185.

The chemical constituents, including bases, oxidizing agents and the dye precursor may be uncoated or may be coated with materials suitable to sequester them by known techniques, including microencapsulation to delay the darkening reaction. For example, a material such as glyceryl monostearate or glyceryl distearate alone or with a wax may be employed as a material suitable for producing an encapsulated, microencapsulated or otherwise sequestered material.

As further examples, an oligomer/polymer of hydroxyacetic acid and lactic acid or a oligomer/polymer of lactic acid and glycolic acid are suitable for use as an encapsulant material for sequestration and can be used in conjunction with nonionic, cationic, anionic and zwitterionic surfactants from a melt or from admixture to produce the encapsulated chemical constituents.

Encapsulated and microencapsulated chemical constituents can be prepared by techniques known in the art; which techniques include pan coating, air suspension coating, centrifugal extrusion, core-shell encapsulation using a vibrational nozzle, spray drying, ionotropic gelation, coacervation, interfacial polycondensation, interfacial crosslinking, in-situ polymerization or matrix polymerization.

The dye precursors can be the unsubstituted catechol compounds or they can have one or both of their phenolic hydroxy groups esterified to form esters which may or may not be pharmaceutically acceptable. The term "dye precursor" is intended to mean either or both of the esterified or unesterified compound or compounds and esters may be formed with organic or inorganic acids. For example boric acid-catechol esters may form with the dye precursor in the presence of boric acid or its salts to form products such as, for example, the following:

I

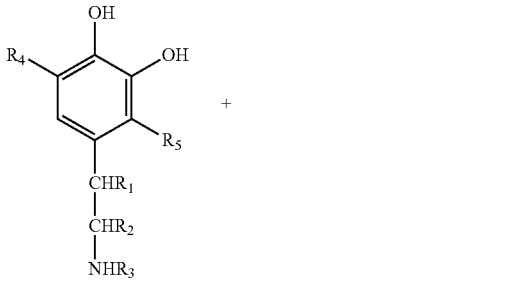

and

II

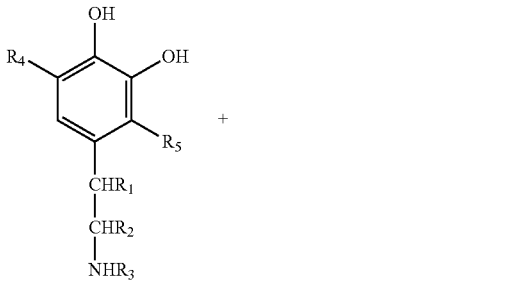

-continued

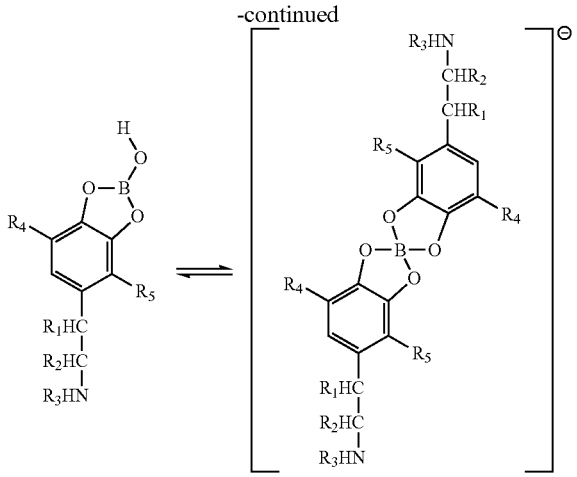

Where $R_1$, $R_2$, $R_3$, $R_4$ and $R_5$ are as given above and the product species in II is an anion, as indicated. It should be understood that the structure given above is only one diastereomer and that the other is also possible. It is known in the art that oxidation of catechol compounds by oxidation agents can be inhibited by esterification in this manner. For example, inhibition of the oxidation of catechol by tyrosinase was shown by Yasunobu et al., J. Biol. Chem., 227, 473, (1957).

In like manner, esters of silicates and other inorganic and organic acid anions may also be formed and inhibit oxidation until heat is applied.

As used herein, the term "pharmaceutically acceptable ester" include, for example, those derived from pharmaceutically acceptable aliphatic carboxylic acids, particularly alkanoic, alkenoic, cycloalkanoic and alkanedioic acids, in which each alkyl or alkenyl moiety has not more than 6 carbon atoms. Examples of particular esters include, but are not limited to, formates, acetates, propionates, butyrates, acrylates and ethylsuccinates.

Although the present invention has been shown and described various changes and modifications which are obvious to persons skilled in the art to which the invention pertains are deemed to lie within the spirit, scope and contemplation of the subject matter set forth in the appended claims.

What is claimed is:

1. A thermosensitive recording medium comprising:

a. a base sheet;

b. a thermosensitive composition on at least one surface of the base sheet comprising a binder and a thermosensitive material comprising:

i. one or more oxidizing agents; and ii. a dye precursor having the formula;

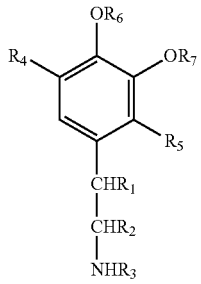

wherein $R_1$ and $R_2$ can be the same or different and are: H, alkyl of 1-4 C, $NH_2$, OH, COOR' wherein R' is alkyl of 1-4C or H, $CONH_2$, halogen, OR" wherein R" is alkyl of 1-4C, $CH_2$ OH, $CH_2NH_2$, CONR'R" wherein R' and R" can be the same or different; $R_3$ is H or alkyl of 1-4C or COR"; $R_4$, $R_5$ can be the same or different and are: H, alkyl of 1-4C, $NH_2$, OH, COOH, $CONH_2$, halogen, OR", $NO_2$, $SO_3$, HNR", or NR"R" or any pharmaceutically acceptable salts thereof or mixtures thereof, and wherein $R_6$ and $R_7$ can be the same or different and can be hydrogen, a carboxylate group, a borate group or a silicate group.

2. The thermosensitive recording medium of claim 1, wherein the binder comprises a resin chosen from polystyrene, polyvinyl alcohol, polyvinyl pyrrolidone, polyacrylamide, polymethacrylamide, polyacrylic acid, polymethacrylic acid, polyethylene glycol, proteinaceous binders, gelatin, modified gelatins, phthaloyl gelatine, polysaccharides, starch, gum arabic and dextran, water-soluble cellulose, resin having an ether bond, resin having a carbamoyl group, resin having a carboxyl group, derivatives or combinations thereof.

3. The thermosensitive recording medium of claim 1, further comprising sodium bicarbonate, potassium bicarbonate, microencapsulated sodium bicarbonate or microencapsulated potassium bicarbonate.

4. The thermosensitive recording medium of claim 1, wherein the dye precursor is chosen from L-DOPA, R-DOPA or pharmaceutically acceptable salts thereof or mixtures thereof.

5. The thermosensitive recording medium of claim 1, wherein $R_1$ and $R_2$ are non hydrogen substituents and the dye precursor comprises two or more diastereomers.

6. The thermosensitive recording medium of claim 1, wherein the oxidizing agent is a pharmaceutically acceptable salt whose anion is chosen from peroxide, periodate, persulfate, perborate, iodate peroxydisulfate, monopersulfate, or hypochlorite.

7. The thermosensitive recording medium of claim 1, wherein the oxidizing agent is chosen from sodium periodate, potassium periodate, ammonium periodate or mixtures thereof.

8. The thermosensitive recording medium of claim 1, further comprising one or more pharmaceutically acceptable carbonate salts.

9. The thermosensitive recording medium of claim 1, wherein the oxidizing agent is a metal salt.

10. The thermosensitive recording medium of claim 1, wherein the oxidizing agent is a transition metal salt.

11. The thermosensitive recording medium of claim 1, wherein the oxidizing agent is a metal salt chosen from copper, titanium, zinc, iron, nickel, cobalt, lead, silver and manganese.

12. The thermosensitive recording medium of claim 1, wherein the thermosensitive recording medium is substantially free of organic base.

13. The thermosensitive recording medium of claim 1, wherein the mole ratio of the oxidizing agent to the dye precursor is greater than about 0.05 and less than about 2.0.

14. The thermosensitive recording medium of claim 1, further comprising an ester capable of retarding the oxidation of the dye precursor.

15. The thermosensitive recording medium of claim 14, wherein the ester is a borate or a silicate.

16. The thermosensitive recording medium of claim 1, wherein at least some of the one or more oxidizing agents are microencapsulated.

17. The thermosensitive recording medium of claim 1, wherein the dye precursor is microencapsulated.

* * * * *